United States Patent [19]

Lucas et al.

[11] 3,945,936

[45] Mar. 23, 1976

[54] BLEACHING ARTICLE

[75] Inventors: Malcolm Bramel Lucas; James Francis McKenna, both of Cincinnati; Francis Louvaine Diehl, Wyoming, all of Ohio

[73] Assignee: The Procter & Gamble Company, Cincinnati, Ohio

[22] Filed: Jan. 29, 1974

[21] Appl. No.: 437,570

[52] U.S. Cl. ..... 252/95; 34/72; 252/90; 252/99; 252/102; 252/186

[51] Int. Cl.[2] ..... C11D 3/395; C11D 7/54

[58] Field of Search ..... 252/90, 95, 99, 102, 186; 34/72

[56] References Cited

UNITED STATES PATENTS

| | | | |
|---|---|---|---|
| 3,154,495 | 10/1964 | Robson et al. | 252/90 |
| 3,180,037 | 4/1965 | Kenreich et al. | 34/72 X |
| 3,701,202 | 10/1972 | Compa et al. | 34/72 |
| 3,779,931 | 12/1973 | Fries et al. | 252/102 X |

*Primary Examiner*—Mayer Weinblatt
*Attorney, Agent, or Firm*—Charles R. Wilson; Jerry J. Yetter; Richard C. Witte

[57] ABSTRACT

A porous article releasably containing a dry, activated bleaching composition suitable for use in an automatic dryer.

9 Claims, No Drawings

BLEACHING ARTICLE

BACKGROUND OF THE INVENTION

The present invention encompasses an article designed to bleach fabrics in an automatic dryer. More specifically, the article herein comprises a porous receptacle releasably containing a solid, substantially dry, activated peroxygen bleach composition. The article releases the bleach composition in a controlled manner, and is especially adapted for use in an automatic dryer.

Fabric treating processes and compositions designed to provide desirable functional and aesthetic benefits to fabrics are conventionally employed in a washing machine. Thus, fabric sizings and softening agents, fabric bleaches and brighteners, and the like, are most commonly formulated and provided as compositions designed for use either in an aqueous laundering liquor or in an aqueous rinse bath. More recently, the treatment of fabrics in an automatic clothes dryer has been shown to be effective means for imparting desirable properties thereto. For example, it is becoming common to soften fabrics in an automatic clothes dryer rather than during the rinse cycle of a laundering operation.

The most familiar method for bleaching fabrics to remove stains, especially in the context of a home laundering operation, is to add an oxidizing bleach directly to the laundering liquor. Liquid hypochlorite solutions are most commonly employed, but solid peroxygen bleaches are also commercially available. Such bleaches are designed for addition to the laundering bath in conjunction with the detergent, and perform their desired bleaching action concurrently with fabric laundering.

The concurrently filed patent application of Diehl and Edwards, Ser. No. 437,569, filed Jan. 29, 1974, incorporated herein by reference, discloses certain solid, dryer-added bleaches which provide substantial bleaching superiority over dry bleaching compositions employed in a laundering liquor. In use, it is preferred that dryer-added bleaches be quickly and evenly dispensed onto the damp fabrics being dried to insure that safe, even and effective bleaching is obtained. Accordingly, a convenient dispensing means to achieve even dispersion is desirable.

U.S. Pat. 3,701,202 discloses a dispensing article for use in an automatic clothes dryer and suggests that fabrics may be softened, bleached, and otherwise desirably treated in the dryer by means of such an article. However, this patent relates to dispensers designed for mounting on the dryer drum and does not suggest the article herein nor operable compositions which can be employed in such articles. See also, U.S. Pat. 3,180,037.

It is an object of the present invention to provide an article designed to achieve through-the-dryer fabric bleaching.

It is another object herein to provide an article which provides controlled release of dryer-bleaching compositions especially adapted for use in conjunction with the limited amount of water available as a reaction medium in an automatic clothes dryer.

These and other objects are obtained herein as will be seen from the following disclosure.

SUMMARY OF THE INVENTION

The present invention encompasses an article of manufacture especially adapted for bleaching fabrics in an automatic clothes dryer, comprising: (a) a water-insoluble, closed, flexible receptable, at least one wall of said receptacle comprising a material having a plurality of passages from inner to outer surfaces; and (b) an effective amount of a particulate, water-soluble fabric bleaching composition, said bleaching composition being releasably enclosed within the cavity of said receptacle.

In its most preferred embodiment, the article herein comprises a sealed, open pore polyurethane pouch containing a granular bleach composition which is dispensed through the walls of the pouch by the tumbling action of the dryer.

DETAILED DESCRIPTION OF THE INVENTION

The bleaching article herein comprises a receptacle having a porous member in at least one of its walls, said receptacle being closed to contain a bleaching composition, all as described more fully hereinafter.

Receptacle

The article herein comprises a water-insoluble, closed receptacle containing within its cavity a bleaching composition. The receptacle has at least one opening in its walls through which the bleaching composition is released. Inasmuch as the receptacle is to be used in an automatic dryer, it is comprised of a heat resistant material, or a material which can be rendered heat resistant at dryer operating temperatures. Moreover, the receptacle is fashioned from a material which is resistant to oxidation by the bleaching composition contained therein, both at ambient and dryer operating temperatures. Since the article is designed for use in contact with damp clothing, it is made from a water-insoluble material. The receptacle herein can be made from open-weave cotton, polyester, and the like, cloth. The open-weave structure can be chosen to provide controlled release of the bleaching composition.

Preferred receptacles for use herein are fashioned from cellular foam materials having a plurality of passages from inner to outer surfaces. Such foams are known in the art as "open pore" or "open call" foams, and have a large proportion of cells which are interconnected, thereby providing passageways, or "pores", through the interconnecting cells. Open pore foams are distinguished from "closed pore" cellular foams in which the closed pore structure substantially isolates the individual cells.

Open pore foams can be made from polystyrene, polyurethane, polyethylene, poly-(vinyl chloride) cellulose acetate, phenol-formaldehyde and other foamed polymeric materials such as cellular rubber. Many of these foams and their method of manufacture are disclosed in standard references such as the *Encyclopedia of Polymer Science and Technology*, Interscience Publishers, John Wiley & Sons, Inc. (1965), incorporated herein by reference.

Preferred materials for preparing the receptacles herein are open pore polyurethane foams widely known in the art. The open pore polyurethanes are resistant to heat, oxidation and water, and can be prepared in a variety of pore "sizes". The preparation of many recently developed foams is described in the text, *Cellular Plastics Recent Developments* (1970), Johnson, Noyes Data Corporation and in the *Encyclopedia of Polymer Science and Technology*, supra. In general, urethane foams are prepared by polymerizing diisocyanates and hydroxyl-terminated polyethers or polyesters. Foaming is accomplished by including water and optional foaming agents in the reaction system, and the reaction between the isocyanate and water releases carbon dioxide gas which foams the polymer.

The foamed receptacles herein provide controlled release of the particulate bleaching composition during the drying cycle. The controlled release insures uniform and measured dispensing of the bleaching composition onto the surfaces of all fabrics within the dryer. More specifically, during the drying operation the bleaching composition sifts through the plurality of passages in the walls of the receptacles. This shifting action is facilitated by the tumbling action receptacles. the dryer.

Water is required to provide a reaction medium for the bleaching composition, and the porosity of the receptacle is selected so that the bleaching composition is substantially all released from the receptacle before all the water is evaporated from the fabrics. Moreover, it is preferred that the bleaching composition be released rapidly, but uniformly, during the early stages of the drying cycle when sufficient water is present on the fabrics to dissolve the bleaching composition. If the bleach is dispensed onto the substantially dried clothes late in the drying cycle, it is either lost by venting from the dryer, or can appear as undesirable dust on the dried fabrics.

The preferred receptacles herein release the particulate bleaching composition during the first one-quarter of the drying cycle, when the fabrics are still quite damp. In conventional home dryers, this preferred period comes within the first 10 minutes to 15 minutes of the drying cycle.

Bleaching Composition

The bleaching compositions employed herein can be any of a variety of solid, water-soluble materials known in the art to be safe and effective for removing stains from fabrics. The solid peroxygen bleaches are preferred for use over chlorine bleaches, inasmuch as peroxygen bleaches are less likely to damage fabric dyes. Mixtures of bleaches and bleach/activator mixtures can also be employed as the bleaching compositions herein.

Peroxygen bleaches useful herein include the common inorganic peroxy-compounds such as the alkali metal and ammonium perborates, percarbonates, monopersulfates and monoperphosphates. It is well-known that these inorganic peroxygen bleaches exist as various hydrates, but the degree of hydration is not important to the practice of the present invention. Examples of these peroxygen bleaches include the sodium and potassium perborates, the sodium and potassium percarbonates, and complex per-salts such as $KHSO_4.K_2SO_4.2KSO_5$, marketed under the tradename Oxone. The water-soluble perborates, especially in combination with an activator, are particularly preferred herein on the basis of bleaching performance, fabric safety and availability.

Solid, water-soluble organic peroxy acids, or the water-soluble, e.g., alkali metal, salts thereof of the general formula $$HO-O-\overset{\overset{\displaystyle O}{\|}}{C}-R-YH$$

wherein R is a substituted or unsubstituted alkylene or arylene group and Y is $$-\overset{\overset{\displaystyle O}{\|}}{C}-O-O-, \quad -\underset{\underset{\displaystyle O}{\|}}{\overset{\overset{\displaystyle O}{\|}}{S}}-O \quad \text{or} \quad O-\overset{\overset{\displaystyle O}{\|}}{C}-O-O-$$

or any other group which yields an anionic group in aqueous solution are useful herein. These organic peroxy acids and their use in combination with activators as highly water-soluble, micellar bleaches are more fully described in U.S. Pat. 3,749,673, incorporated by reference.

The mixtures of organic peroxy acids and persulfate bleaches described in U.S. Pat. 3,773,673, incorporated herein by reference, are also highly water-soluble and useful in the present invention.

The above peroxygen bleaching compounds and mixtures can be used singly herein to bleach fabrics. However, various bleaching activators can be advantageously employed to enhance bleaching performance. The use of such activators is especially preferred when the inorganic peroxygen bleaches are employed in the bleaching compositions herein. While not intending to be limited by theory, the need for such activators arises due to the relatively short time available for effective bleaching in the automatic dryer. The bleaching compositions useful in an automatic dryer are designed to act while there is sufficient water remaining on the fabrics to provide a reaction medium in which the bleaching reaction can occur. Accordingly, any means whereby the bleaching composition is made more readily soluble and reactive in the limited amount of available water is of advantage in a through-the-dryer bleaching composition.

Inorganic peroxygen bleaches can be employed in combination with various solid activators and used as the bleaching compositions herein. Suitable activators for a wide variety of inorganic bleaches are set forth in U.S. Pat. 3,130,165, incorporated herein by reference. In particular, such activators include various esters of phenols or substituted phenols with alpha-chlorinated lower aliphatic carboxylic acids, such as chloracetic acid or alpha-chloropropionic acid, said esters containing no ester group of any acid other than alpha-chlorinated lower aliphatic carboxylic acids.

The alkali metal perborates, especially sodium perborate, and ammonium perborate constitute a preferred, safe and effective class of bleaches herein when used in combination with an activator. Many perborate bleaching activators are known in the art. Materials such as the acylphosphonic acid esters, N,N'-diarylsulphamides, carboxylic acid anhydrides, N-acylamides, N-acylated heterocycles, acylhydroxylamines and other like compounds which readily acylate the peroxy compounds are well-recognized perborate activators.

Included among such perborate activators are tetraacetyl methylenediamine, acetyl esters of sodium phenol sulfonate, chloroacetylsalicyclic acid, 1-phenyl-3-acetyl hydantoin, tetraacetyl ethylenediamine, α-D-glucose pentaacetate, p-phenylene diacetate, tris-(acetyl) cyanuric acid, N-methyl-N-benzoyl-p-toluene sulfonamide, benzoyl chloride, and N-benzoyl imidazole. Other perborate activators are listed in U.S. Pat. Nos. 3,177,148 and 3,779,931, incorporated herein by reference.

A most highly preferred perborate activator herein is 1,3,4,6-tetra-acetyl glycouril, abbreviated TAGU. TAGU can be prepared in the manner set forth in Henkel Referate 1973 (8), 28–33.

It is to be recognized that other solid, water-soluble bleaching compositions suitable for use herein can be prepared by admixing inorganic and organic bleaches. Examples of such mixed bleaches include sodium perborate/p-methoxyperbenzoic acid, and the like. Such mixed bleaches can optionally be activated, for example, by TAGU.

The activated bleaching compositions herein can contain the activator in either catalytic amounts or in proportions of bleach:activator which are more nearly stoichiometric ratios. As noted above, many perborate activators appear to function by an acylation reaction and are not catalytic in the accepted sense of that term. In such instances, it is well-recognized that sufficient activator is employed to satisfy the stoichiometric requirements of the bleaching reaction.

A preferred bleaching composition for use herein comprises sodium perborate and TAGU at a weight ratio of perborate:TAGU of from about 1:3 to about 30:1. A highly preferred bleach composition comprises from about 1 part to about 10 parts by weight of sodium perborate and from about 2 parts to about 1 part by weight of TAGU.

Optional Components

The fabric bleaching compositions herein can optionally contain minor proportions (i.e., 0.1% to about 15% by weight) of various ingredients which provide additional fabric conditioning benefits. Such optional ingredients include perfumes, anti-static agents, fumigants, bactericides, fungicides, optical brighteners, and the like. Specific examples of typical solid, water-soluble additives useful herein can be found in any current Year Book of the American Association of Textile Chemists and Colorists. Such additional components can be selected from those compounds which are known to be compatible with the bleaches and activators employed herein, or can be coated with water-soluble coatings such as solid soaps, and the like, and thereby rendered compatible.

Useful optional ingredients herein include $C_8$–$C_{20}$ amines, imidazolines, and quaternary ammonium salts widely recognized for use as fabric softening and anti-static agents. Specific examples of such materials include the mixed tallow-alkyl amines, di-tallowalkyl-dimethylammonium chloride, and the like.

The water-soluble silicate materials recognized in the art as corrosion inhibitors can be advantageously employed in the present compositions at levels of about 5% by weight.

The water-soluble, solid optical bleaches, especially bis-(styrylsulfonate)biphenyl, can advantageously be employed in the present compositions to provide an added brightening effect on the bleached fabrics.

It will be recognized that any of the foregoing types of optional components can be provided in a solid, particulate form which can be dispensed onto the damp fabrics concurrently with the bleaching composition herein to provide the desired additional fabric treatment benefits.

Preparation and Usage

The articles of the present invention are prepared by fashioning a receptacle of the type hereinabove described and enclosing therein an effective amount of the bleaching composition. By an "effective amount" of the bleaching composition herein is meant an amount sufficient to remove the stains from an average load of fabrics in an automatic dryer. Of course, the actual amount of the bleaching composition employed will depend on the fabric load, the amount of stain to be removed, and the bleaching composition selected for use in the article. For an average 5 lbs. to 8 lbs. load of medium-to-heavily stained fabrics, from about 10 grams to about 50 grams, preferably 20 grams to 30 grams, of any of the foregoing the bleaching compositions provide good stain removal.

When preparing the articles herein the rate of release of the bleaching composition from the receptacle is preferably optimized. The rate of release should not be so fast that the composition is deposited in an uneven manner on the fabrics. Conversely, the rate of release of the bleaching composition from the receptacle must not be too slow, since all, or substantially all, of the composition is preferably dispensed onto the fabrics while they are still damp. The rate of release of the bleaching composition depends on both the porosity of the receptacle and the particle size of the bleaching composition. Of course, the average diameter of the bleaching composition must be somewhat smaller than the average pore diameter of the porous openings in the receptacle to achieve release. Moreover, the bleaching compositions of the present invention are employed as fine powders or dusts which rapidly dissolve in the limited amount of water available in the damp fabrics. Bleaching compositions having an average particle diameter below about 200 microns ($\mu$), and preferably falling in the range from about 25$\mu$ to about 175$\mu$, are rapidly dissolved in water and are preferred for use herein. Accordingly, receptacles having a pore diameter somewhat larger, ca. 5%–10% larger, than the particle diameter of the bleaching composition provide controlled, even release.

The polyurethane foams employed in the preferred receptacles herein can be defined in terms of average pore diameter, and polyurethane foams having rigorously controlled pore sizes are commercially available. However, such materials are quite expensive as compared with the common open pore polyurethanes having mixed pore diameters. The common open pore polyurethanes are more often characterized in terms of their density in lbs./cu.ft. The density of polyurethane foams depends almost wholly on the size of the void spaces therein, and these void spaces are fairly regular in size. Accordingly, by designating the density of the polyurethane foams, the pore sizes are necessarily defined. Open pore polyurethane foams have a density of from about 0.75 lbs./cu.ft. to about 1.5 lbs./cu.ft. are useful herein.

In addition to the density of the polyurethane foam and the particle size of the bleaching compositions herein, the thickness of the polyurethane foam will have an effect on the dispensing rate. As noted hereinabove, it is preferred that the bleaching composition be substantially completely dispensed onto the fabrics within the first 10–15 minutes of the drying cycle. Polyurethane foams having a density from about 0.75 lbs./cu.ft. to about 1.5 lbs./cu.ft. and a thickness of from about 0.10 in. to about 0.50 in. when used in combination with bleaching compositions having the above-described particle sizes provide this preferred rate of release.

The receptacle herein can be provided in a variety of sizes and shapes, and the particular configuration of the receptacle is not critical to the practice of this invention. For example, the receptacle herein can be provided wherein only one wall, or a portion of one wall, comprises a porous opening through which the bleaching composition is dispensed. Preferably the whole of the receptacle can comprise a porous material through which the bleaching composition sifts in a manner akin to a rosin bag.

In its simplest and preferred aspect, the receptacle herein is prepared in the form of a pouch. Preferred receptacles herein comprise an open pore polyurethane foam pouch containing the bleaching composition. The pouch is formed by folding the polyurethane sheet into the desired pouch or pouch-like configuration and sealing the edges, for example by heat-sealing, leaving an opening along one edge. The bleaching composition is added to the pouch opening, which is then sealed. The resulting pouch releases the bleaching composition through its porous walls upon agitation, e.g., by the tumbling action of an automatic dryer.

A highly preferred article herein comprises (a) a water-insoluble, closed, flexible, pouch, the walls of said pouch consisting of open pore polyurethane foam having a density of about 1.10 lbs./cu.ft. to about 1.30 lbs./cu.ft. and a thickness of from about 0.15 in. to about 0.35 in. and (b) a bleaching amount of a particulate fabric bleaching composition consisting essentially of sodium perborate and 1,3,4,6-tetra-acetyl glycoluril, said bleaching composition having an average particle diameter below about 150$\mu$.

The articles herein are used in the following manner. Damp fabrics, usually containing from about 1 to 1.5 times their weight of water, are placed in the drum of an automatic clothes dryer. In practice, such damp fabrics are commonly obtained by laundering, rinsing and spin-drying in a standard washing machine. The bleaching article is simply placed in the dryer, which is then operated in standard fashion to dry the fabrics, usually at a temperature from about 50°C. to about 80°C for a period of from about 5 minutes to about 50 minutes, depending on the fabric load and type. The tumbling action of the revolving dryer drum commingles the bleaching article with the fabrics and evenly dispenses the bleaching composition on the fabric surfaces.

The following examples illustrate the present invention but are not intended to be limiting thereof.

EXAMPLE I

Bleaching Composition

| Ingredient | Wt. % |
|---|---|
| Sodium perborate | 66.67 |
| TAGU* | 33.33 |

*As defined hereinabove

The sodium perborate was screened through a 100 mesh screen (149$\mu$) and the coarse particles which did not pass through the screen were discarded.

The bleaching composition was prepared by admixing 18.67 grams of the screened perborate and 9.33 grams of TAGU. The resulting bleaching composition had an average particle size below about 150$\mu$.

The bleaching composition prepared in the foregoing manner was placed in a polyurethane (density 1.2 lbs./cu. ft.) pouch formed from a piece of open pore polyurethane 7 in. × 5 in. The polyurethane was one-fourth in. thick. This bleaching article was employed in a through-the-dryer bleaching operation and compared with commercial bleaching compositions employed in a standard through-the-wash bleaching operation.

The testing procedure used to evaluate the bleaching process employing the pouch article of Example I was as follows. Five lbs. of terry wash cloths were placed in a Kenmore Washer, Model 110, together with eight uniform (5.0 in. × 5.0 in.) cotton cloth swatches stained with standardized tea, coffee and brown gravy stains. The stained swatches were intermingled with the terry wash cloths prior to washing to simulate the type of treatment that would be encountered in a standard washing procedure involving patches of heavy stain on clothing. In the test procedure, four swatches were stained with tea, two with coffee and two with brown gravy. The washer was operated under the manufacturer's suggested operating conditions using 17 gallons of wash water of 7 grain hardness at a temperature of about 125°F in the wash cycle. 70 Grams of a standard commercial built anionic detergent composition were employed to launder the fabrics. Four separate washer runs, denoted as Runs A through D were made.

In Run A, a chlorine bleach was added to the rinse cycle through a bleach dispenser in the manner recommended by the manufacturer. The commercial bleach was employed at a concentration of 200 ppm of available chlorine.

In Run B, 103 grams of a commercial sodium perborate bleaching composition were added to the laundering liquor in accordance with the washer manufacturer's recommended procedure. This amount of bleaching composition was calculated to provide 55 ppm of available oxygen in the wash liquor.

Runs C and D involved only laundering, rinsing, and spin-drying the fabric bundle, without added bleach.

The fabric bundles of Runs A, B and C were dried in a standard commercial dryer using the manufacturer's recommended procedure.

The spun-dried, damp fabrics of Run D were placed in a commercial dryer together with the article of Example I. The fabrics were dried according to the manufacturer's operating instructions.

The standard stain swatches were separated from the terry towels and their degree of whiteness was evaluated using a Hunter Color and Color Difference Meter, in combination with a Roland, Robinson readout device (model AS/026), and the L, *a* and *b* values thereby obtained were substituted in the whiteness equation derived in a manner analogous to the whiteness equation in the article by F. Diehl, "A Single Number Expression for Whiteness Evaluation of Washed Fabrics", in *Proceedings of the IV International Congress on Surface Active Substances*, Brussels 7–12 September, 1964, vol. III, section C of the Congress, incorporated herein by reference.

This whiteness equation, $$W = 100 - ((100-L)^2 + 1.44\,[(a-4.1)^2 + (b+8.0)^2])^{1/2}$$

is especially adapted to modern fabrics with fluorescent whitening agents.

The bleaching results from the test are set forth in Table I. The higher the number in the table, the more efficient is the bleaching. Two units on the Diehl scale have been shown to be visually recognizable by the average observer.

TABLE I

| | Coffee | Brown Gravy | Tea | 3 Stain Average |
|---|---|---|---|---|
| Run A | 9.0 | 6.9 | 18.9 | 11.6 |
| Run B | 3.5 | 1.4 | 2.9 | 2.6 |
| Run C (control) | 0 | 0 | 0 | 0 |
| Run D (Dryer Bleach) | 8.6 | 2.5 | 9.7 | 7.0 |

As can be seen from Table I, Run D, involving the dryer added bleach employed in the manner of this invention, provides more effective stain removal than a commercial perborate bleach employed in an aqueous laundering liquor. Moreover, the bleach herein compared favorably with a commercial chlorine bleach used in an aqueous medium.

EXAMPLE II

Bleaching Composition

| Ingredient | Wt. % |
|---|---|
| Sodium perborate | 65 |
| TAGU | 32.5 |
| bis-(styrylsulfonate)biphenyl* | 0.7 |
| Perfume | 1.7 |

*Optical Brightener

The sodium perborate (as the commercial tetrahydrate) is screened through a 100 mesh screen and the particles which are too large to pass through the screen are discarded. The TAGU, sodium perborate, optical brightener and perfume are dry-mixed and sieved through a second 100 mesh screen to provide a bleaching composition having an average particle diameter below about 150$\mu$.

Eight lbs. of damp fabrics containing a total of ca. 12 lbs. of water and stained with miscellaneous food stains are placed in an automatic dryer at ambient temperature. The fabrics are spread out uniformly on the bottom of the dryer drum. 25 Grams of the composition of Example II are placed in a pouch fashioned from open pore polyurethane having a density of 1.2 lbs./cu.ft. and a wall thickness of one-fourth in. The pouch is sealed with a plastic clip and placed on top of the damp fabrics. The dryer is operated at an average temperature of 60°C, with tumbling, for 60 minutes. During this time, the bleaching composition sifts onto all fabric surfaces in a uniform manner. The fabrics are removed from the dryer and the food stains are found to be evenly and uniformly bleached.

The bleaching composition of Example II is replaced by an equivalent amount of ammonium perborate and TAGU at a 1:1 weight ratio; a 1:1:1 wt. mixture of sodium perborate, TAGU, and p-methoxyperbenzoic acid; a 1:1:1 wt. mixture of sodium perborate, Oxone, and TAGU; and chlorinated trisodium phosphate, respectively, and equivalent bleaching results are secured.

In the procedure of Example II the polyurethane foam pouch is replaced by a cotton bag woven to provide 200$\mu$ openings along one side of the bag. The bleach is evenly dispensed onto the fabrics and even, effective bleaching is secured.

In the foregoing procedure, the bleaching composition is replaced by average equivalent perborate/-TAGU bleaches having particle diameters of 50$\mu$, 100$\mu$ and 175$\mu$, respectively, and even, effective bleaching is secured.

As can be seen from the foregoing, the articles herein are fashioned to provide even, controlled release of the small particles of the fabric bleaching compositions. Fabrics which are laundered and spun dry in an automatic washer retain from 25% to 300% by weight of water, based on total fabric weight, and the small particles of bleach rapidly dissolve therein. The resulting concentration of bleach at the fabric surface, i.e., at the site of the stains, is quite high. For the peroxygen bleaches herein, from about 300 ppm to about 5000 ppm of available $O_2$ per gram of fabric are provided, and this high concentration of bleach effectively removes a wide variety of fabric stains.

What is claimed is:

1. An article of manufacture especially adapted for bleaching fabrics in an automatic clothes dryer, consisting essentially of:

a. a water-insoluble, closed, flexible pouch, at least one wall of said pouch consisting of an open pore polyurethane foam having a density of from about 0.75 lb./cu. ft. to about 1.50 lb./cu. ft.; and b. an effective amount of a solid, particulate, water-soluble fabric bleaching composition consisting essentially of a peroxygen bleach, said bleaching composition being releasably enclosed within the pouch.

2. An article according to claim 1 wherein the pouch is made of open pore polyurethane foam having a density of from about 1.1 lbs/cu. ft. to about 1.3 lbs/cu. ft. and a thickness of from about 0.1 in. to about 0.5 in.

3. An article according to claim 2 wherein the bleaching composition has an average particle diameter of from about 25$\mu$ to about 200$\mu$.

4. An article according to claim 1 wherein the fabric bleaching composition consists essentially of a solid peroxygen bleach and a solid bleach activator.

5. An article according to claim 4 wherein the peroxygen bleach is selected from the group consisting of alkali metal perborates and ammonium perborate.

6. An article according to claim 5 wherein the bleach activator is 1,3,4,6-tetra-acetyl glycouril.

7. An article of manufacture according to claim 1 especially adapted for bleaching fabrics in an automatic dryer, consisting essentially of:

a. a water-insoluble, closed, flexible pouch, the walls of said pouch consisting of open pore polyurethane foam having a density of about 1.1 lbs/cu. ft. to about 1.3 lbs/cu. ft. and a thickness of from about 0.15 in. to about 0.35 in.; and b. a bleaching amount of a particulate fabric bleaching composition consisting essentially of sodium perborate and 1,3,4,6-tetra-acetyl glycouril, said bleaching composition having an average particle diameter below about 150$\mu$.

8. An article according to claim 7 in which the pouch releasably contains from about 20 grams to about 30 grams of the bleaching composition.

9. An article according to claim 8 which includes as an additional component, an effective amount of a particulate optical brightener releasably contained within said pouch.

* * * * *